US008764283B2

(12) United States Patent
Altenhoven et al.

(10) Patent No.: US 8,764,283 B2
(45) Date of Patent: Jul. 1, 2014

(54) PROCESS AND DEVICE FOR FASTENING A GLASS TO A BEZEL

(75) Inventors: Thierry Altenhoven, Courrendlin (CH); Patrick Hawrylko, Neuchatel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 693 days.

(21) Appl. No.: 12/813,213

(22) Filed: Jun. 10, 2010

(65) Prior Publication Data

US 2010/0315909 A1 Dec. 16, 2010

(30) Foreign Application Priority Data

Jun. 10, 2009 (EP) ..... 09162411

(51) Int. Cl.

| | |
|---|---|
| ***G04B 37/00*** | (2006.01) |
| ***G04B 3/00*** | (2006.01) |
| ***G04B 39/00*** | (2006.01) |
| ***G04B 39/02*** | (2006.01) |

(52) U.S. Cl.

CPC ..... *G04B 37/0008* (2013.01); *G04B 39/00* (2013.01); *G04B 39/02* (2013.01)

USPC ..... 368/294; 368/295; 368/296

(58) Field of Classification Search

USPC ..... 368/281, 294–296

See application file for complete search history.

(56) References Cited

U.S. PATENT DOCUMENTS

| | | | | |
|---|---|---|---|---|
| 1,239,467 | A * | 9/1917 | Depollier | 368/294 |
| 2,589,902 | A * | 3/1952 | Vaurillon | 368/291 |
| 2,595,172 | A * | 4/1952 | Schenke | 368/294 |
| 2,607,082 | A * | 8/1952 | Starke | 264/486 |
| 2,792,684 | A * | 5/1957 | Dinstman | 368/294 |
| 3,386,239 | A * | 6/1968 | Shiffman | 368/296 |
| 4,322,834 | A * | 3/1982 | Schaeren et al. | 368/296 |
| 4,433,921 | A * | 2/1984 | Gogniat et al. | 368/294 |
| 4,561,783 | A * | 12/1985 | Lederrey | 368/309 |
| 4,589,886 | A * | 5/1986 | Gogniat et al. | 29/896.33 |
| 4,623,262 | A * | 11/1986 | Gogniat et al. | 368/294 |
| 4,648,722 | A * | 3/1987 | Mock et al. | 368/294 |
| 5,005,161 | A * | 4/1991 | Boilen | 368/295 |
| 5,033,035 | A * | 7/1991 | Affolter | 368/294 |
| 5,321,670 | A * | 6/1994 | Rebeaud et al. | 368/291 |
| 6,053,631 | A * | 4/2000 | Mock et al. | 368/281 |
| 2006/0256667 | A1* | 11/2006 | Wyssbrod | 368/294 |

FOREIGN PATENT DOCUMENTS

| | | |
|---|---|---|
| CH | 343948 | 2/1960 |
| CH | 10 548/64 | 3/1967 |
| CH | 659 561 | 2/1987 |
| EP | 0 111 449 | 6/1984 |

(Continued)

OTHER PUBLICATIONS

European Search Report issued in corresponding application No. EP 09 16 2411, completed Oct. 7, 2009.

*Primary Examiner* — Vit W Miska

(74) *Attorney, Agent, or Firm* — Griffin & Szipl, P.C.

(57) ABSTRACT

Method of fastening a glass to a watch bezel, wherein the glass has a plurality of studs or a plurality of holes or a plurality of studs and holes and the bezel has a plurality of studs or a plurality of holes or a plurality of studs and holes. The method is characterized in that it comprises a step of pressing the studs into the holes.

10 Claims, 5 Drawing Sheets

(56) References Cited

FOREIGN PATENT DOCUMENTS

| | | |
|---|---|---|
| EP | 1 033 633 | 9/2000 |
| EP | 1 291 739 | 3/2003 |
| EP | 1 722 283 | 11/2006 |
| FR | 2.051.627 | 4/1971 |
| FR | 2 791 442 | 9/2000 |

* cited by examiner

PROCESS AND DEVICE FOR FASTENING A GLASS TO A BEZEL

This application claims priority from European Patent Application No. 09162411.4, filed Jun. 10, 2009, the entire disclosure of which is incorporated herein by reference.

FIELD OF THE INVENTION

The present invention relates to the field of clockmaking. More specifically, it relates to a process for fastening a glass to a bezel. The invention also relates to a glass and a bezel for implementation of this fastening process.

BACKGROUND OF THE INVENTION

So-called friction mounting methods, in which a glass is pressed into an annular recess of a bezel, are known for mounting glasses on watch bezels. Such a fastening method described in document EP 1291739, for example, requires the use of a joining strip to absorb the radial compression forces of the glass in the opening of the bezel. Document EP 1033633 describes another method of fastening a glass by pressing it in using an annular joining strip that is optimised to ensure the seal of the watch case.

Another fastening method is proposed in document EP 0111449, which describes a fastening method with a glass with lugs, i.e. that has fastening pins perpendicular to the plane of the glass and are inserted into internal screw threads during assembly. However, fastening is not achieved by pressing in, but by thermo-adhesion, which makes the process more complex and more costly to perform.

Other fastening methods are also known, in particular for bezels and glasses made of plastic that use adhesion, ultrasonic welding or even clamping fastening elements by elastic deformation during mounting. However, adhesion requires a painstaking operation for mass production; ultrasonic welding requires substantial investment. Finally, machining complicated geometries for the parts to be clamped in place also requires complex production tools.

SUMMARY OF THE INVENTION

Therefore, an aim of the present invention is to propose a solution free from the abovementioned disadvantages of the prior art.

Another aim of the present invention is to propose a simple assembly that is easy to perform with few parts.

These aims are achieved by a method of fastening a glass to a watch bezel, wherein the glass has at least one protruding part and/or a recess and the bezel has at least one protruding part and/or a recess, the method being characterised in that it comprises a step of pressing the protruding part into the recess.

These aims are also achieved by a watch bezel comprising at least one protruding part and/or a recess, characterised in that the protruding part and/or the recess are intended for a pressing-in operation, and also a watch glass comprising at least one protruding part and/or a recess, characterised in that the protruding part and/or the recess are intended for a pressing-in operation.

These aims are further achieved by an assembly comprising a glass and a watch bezel, wherein the glass has at least one protruding part and/or a recess and the bezel has at least one protruding part and/or a recess, the device being characterised in that a protruding part can be pressed into a recess.

An advantage of the proposed solution is that it can be adapted in particular for glasses and bezels made of plastic, in which the plastic deformation renders the machining of a sealing strip unnecessary.

Another advantage of the proposed solution is that only a relatively simple set of equipment is required for assembly.

An additional advantage of the proposed solution is to facilitate machining of the assembly parts of the bezel and the glass of the watch.

Thus, the production costs are reduced as a result of the simplification of the equipment required for machining the parts as well as for their assembly. Moreover, the reduction in the operating time allows the output to be increased and therefore the efficiency to be increased for the production.

BRIEF DESCRIPTION OF THE DRAWINGS

Other features and advantages will become more clear from the detailed description of various embodiments and the attached drawings.

DETAILED DESCRIPTION OF THE ILLUSTRATIVE EMBODIMENTS

The invention involves the concept of pressing in for the assembly one or more protruding or "male" parts, which are accommodated in one or more recesses, i.e. "female" receptacles, by pressure. The assembly of these male/female elements is assured by virtue of the elastic deformation of at least one of the parts involved in the pressing-in operation that allows the "male" element to penetrate into the "female" element. The pressing-in is also often described as crimping, in particular when (possibly precious) stones have to be forced into an orifice. The holding in assembled position of the parts is then assured by frictional forces acting between the contact surfaces of the assembled parts, while one of the at least two assembly parts continues to be subjected to elastic deformation forces.

Figure 1A:
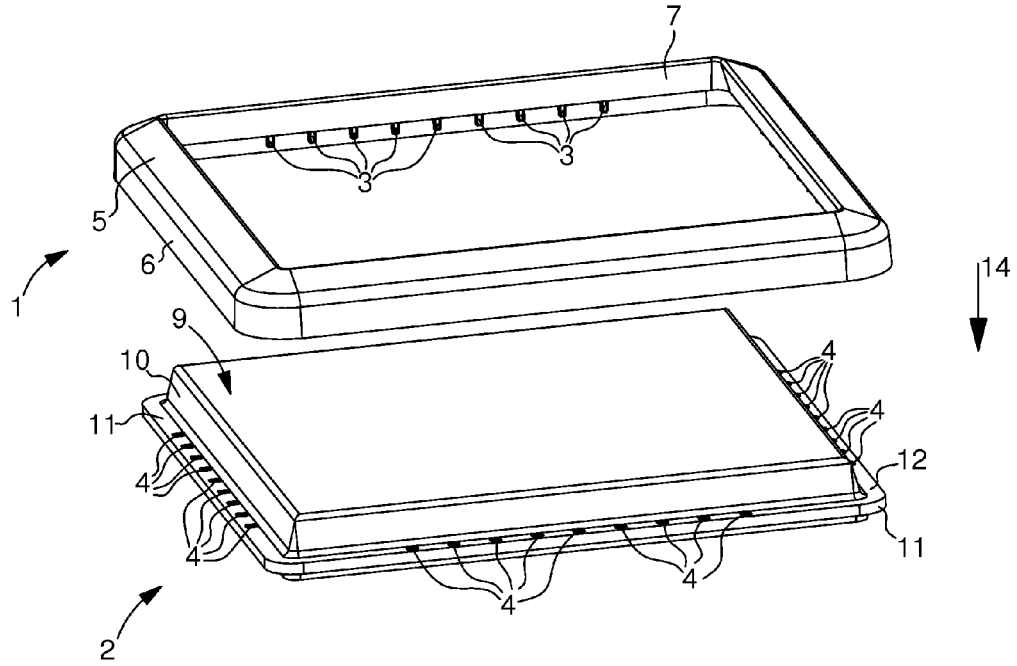
FIGS. 1A and 1B are perspective views of a bezel and a glass according to a preferred embodiment of the invention.
Figure 1B:
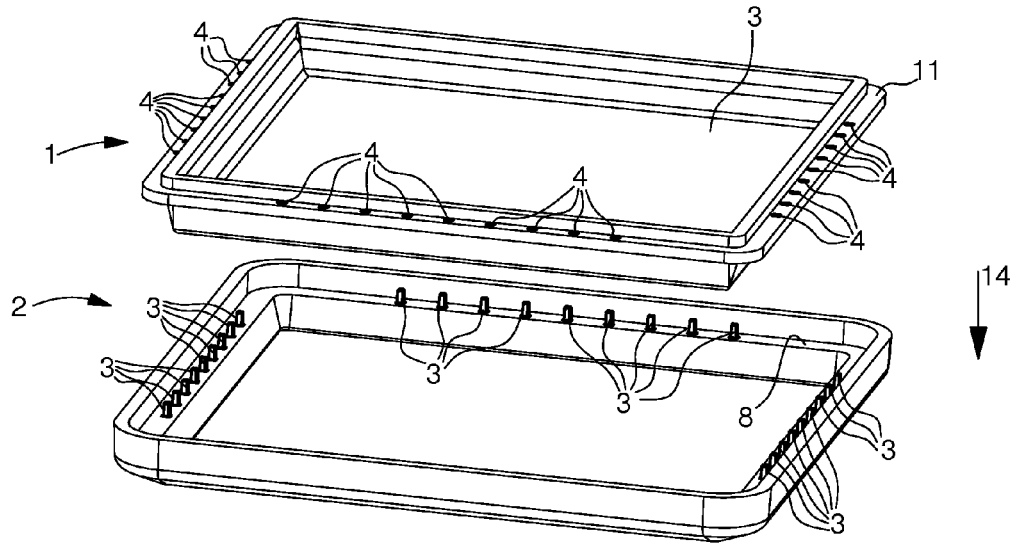

FIG. 1A illustrates a bezel 1 and a glass 2 according to a preferred variant of the invention that are not assembled. It is possible to discern on the bezel the substantially vertical outer side walls 6 and an upper outside face 5 forming an almost horizontal surface that is slightly cambered to better mould to the contours of the surface of the glass, as will be seen further below with respect to the following figures. The bezel 1 is placed on the peripheral rim 11 of the glass 1, which according to this embodiment is provided with a plurality of holes 4 serving as recesses, into which studs 3 of the bezel engage, as shown in FIG. 1B that shows the same bezel 1 and glass 2 viewed from below, and which studs act as protruding parts for the pressing-in operation. The studs 3 and the holes 4 are designed in such a way that they have corresponding "male" and "female" forms to allow the pressing-in operation. Any geometric three-dimensional form whatsoever that meets this requirement of correspondence of shapes is conceivable.

The upper outside slightly cambered face of the glass 9 can also be seen from FIG. 1A as well as the outer side edge 10 formed by practically vertical walls. The bezel is square in this preferred variant. However, any other geometric shape (round, oval, trapezoidal . . . ) may also be envisaged within the framework of the invention. Similarly, the inclination of the walls forming the edge of the glass (reference 10) or of the bezel (reference 6) could be modified for aesthetic or functional reasons such as the ease of machining parts, for example, without adversely affecting the fastening method or device of the invention. This also applies to the shape of the surface of the glass 9 and the surface of the outside face of the bezel 6.

The direction for the pressing-in operation during assembly of the bezel on the glass or vice versa is indicated by arrow 14, which also indicates the pressing-in direction. The direction of arrow 14 here is substantially perpendicular to the plane formed by the upper outside face of the glass 9 and therefore, with the geometric shapes used for the bezel, allows the bezel to be fastened to the glass 2 to keep the glass immobile during the pressing-in step. This feature can be of interest to simplify the necessary equipment for assembly, avoiding complex and costly equipment such as hydraulic or pneumatic presses, since a simple bracket may suffice to fasten the bezel to the glass. Since, in principle, the grip of the bezel 1 is simpler than that of the glass 2, this method of fastening the bezel on the glass, in which the direction of pressing-in 14 is directed from the bezel towards the glass (downwards in the figure), could be favoured. However, it is also a possibility in the framework of the invention to fasten the glass 2 to the bezel 1, wherein the direction of pressing-in 14 would then be reversed.

FIG. 1B, which shows a symmetrical view in relation to FIG. 1A with respect to the horizontal plane, reveals the inside faces of the glass 13 and the bezel 8. The peripheral rim 11 of the glass as well as the opposite end of the holes 4 are still clearly evident. The inner side edge of the glass 7, on which the edge of the glass 10 will come to rest, can also be seen.

According to the preferred variant illustrated, the protruding parts forming the studs 3 are located on this inside face 8 of the bezel 2. The pressing-in direction 14 according to this figure indicates that the glass 2 appears to have been placed on the bezel 1, which is thus the reverse assembly to that shown in the preceding FIG. 1A. According to FIG. 1B, the glass 2 is in fact fastened to the bezel 1 and not the other way round. It is the glass 2 that is placed on the bezel 1 for the pressing-in operation. The bezel 1 can thus remain immobile in this case during this pressing-in operation.

Figure 2A:
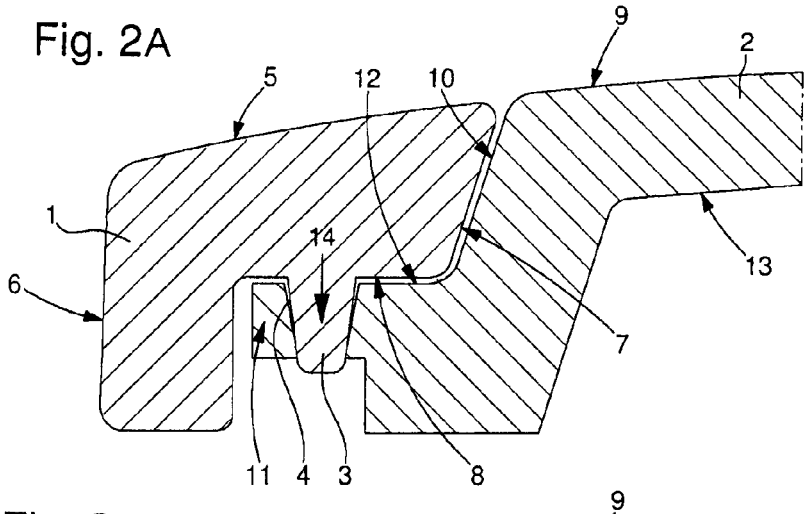
FIG. 2A is a sectional view of the bezel and glass according to the preferred embodiment of the invention illustrated in FIGS. 1A and 1B.

FIG. 2A shows a sectional view of the glass 2 and the bezel 1 of the preferred variant of FIGS. 1A and 1B once they have been assembled, i.e. after the pressing-in operation. The contour of the outer side faces 6 and upper outside face 5 of the bezel 2 as well as the upper outside face 9 of the glass 2 can be seen in FIG. 2A. The peripheral edge 11 encircling the glass and giving the glass a hat-like shape in the chosen plane is also evident. As is clear from the figure, the upper outside faces of the bezel 5 and the glass 9 are designed in such a way that they are each extended once the pressing-in step has been performed. According to the variant represented, they form an almost continuous, slightly cambered contour on the outside face of the watch visible to the user. A person skilled in the art could conceive other contour shapes.

The juxtaposition of the surfaces formed by the side edge 10 of the glass and the inner side edge of the bezel 7 can also be seen in FIG. 2A. According to the preferred variant illustrated, these side edges 7, 10 form substantially vertical walls and are free from frictional forces during the pressing-in step. This absence of frictional forces enables better distribution of the stress on the holes 4 and the studs 3, which are the parts under stress in the pressing-in operation. Moreover, it is achieved more readily because the orientation of the walls of the side edges 7, 10 is parallel to the pressing-in direction, which is indicated by the arrow 14.

According to the preferred variant illustrated in FIG. 2A, the protruding parts are studs 3 arranged on the inside face 8 of the bezel 2, whereas the recesses are holes 4 located in the peripheral rim 11 of the glass 2. A person skilled in the art will understand that it is not necessary for the holes to penetrate through the peripheral rim 11, but that it is, however, necessary according to this embodiment that the recesses are formed in the upper face 12 of the peripheral rim 11 of the glass 2. Moreover, the arrangement of the recesses and the protruding parts can be distributed over the inside face 8 of the bezel and the upper face 12 of the peripheral rim 11 of the glass 2, i.e. the inside face 8 can have only protruding parts, or only recesses, or both alternately, for example, (i.e. a hole followed by a protruding part), and the same applies to the upper face 12 of the peripheral rim 11 of the glass 2.

Figure 2B:
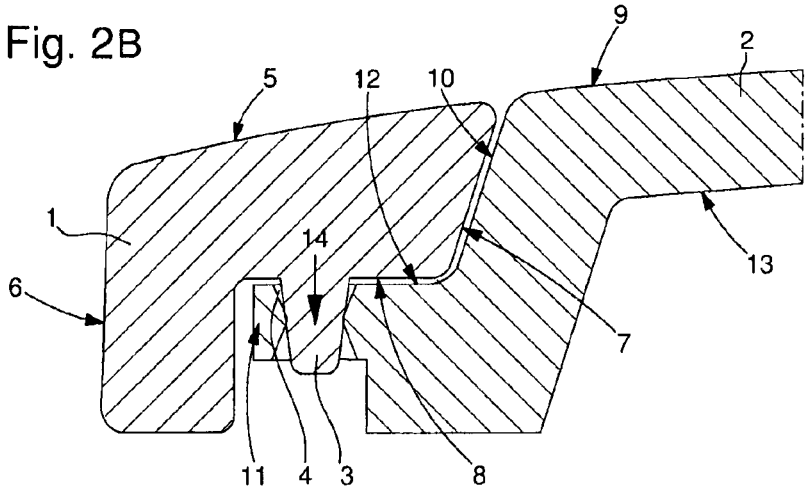
FIG. 2B is a sectional view of the bezel and glass according to the preferred embodiment of the invention illustrated in FIGS. 1A and 1B similar to FIG. 2A but with studs and holes with inversed conicity.

FIG. 2B illustrates the same sectional view as FIG. 2A for a very similar embodiment, in fact identical in all points except for the reversal of the conicity of the studs 3 and the holes 4 in relation to FIG. 2A. According to the embodiment illustrated in FIG. 2B, it has been chosen to reverse only the conicity of the hole 4. This variant has the advantage, as will be seen further below, of allowing the end of the stud to be embedded in some adhesive to improve the hold of the bezel 1 on the glass 2. However, a skilled person will understand that it is also possible to reverse the conicity of the stud 3. According to this embodiment, the interaction between hole and recess has an hourglass shape, which assumes that the material of the stud 3 is less deformable than that of the hole 4, which thus moulds to the shape of the stud 3.

Figure 3:
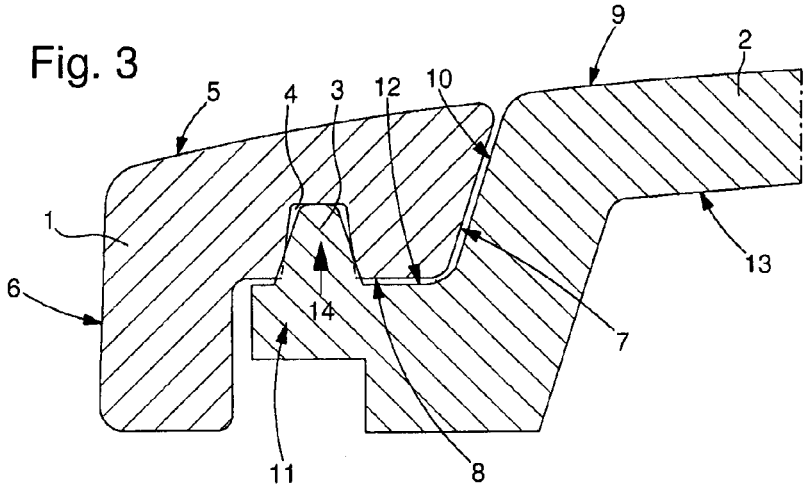
FIG. 3 is a sectional view of the bezel and glass of another preferred embodiment according to the invention.

FIG. 3 shows another embodiment of the invention, which constitutes a preferred variant in the same way as that illustrated in FIG. 2A. It may be noted that the references are identical in all points, but that the arrangement of the studs 3 and the holes 4 has been reversed in relation to the embodiment of FIG. 2A. The studs 3 are now accommodated on the upper face 12 of the peripheral rim 11 of the glass 2, while the recesses 4 are now arranged in the inside face 8 of the bezel 1. It may be noted that according to this variant the pressing-in direction indicated by the arrow 14 is preferable inverted or oriented upwards so that the "male" elements (the studs 3) are locked into the holes 4 and not the reverse, i.e. to place and press the bezel 1 provided with holes 4 onto the glass 2. According to the illustrated embodiment, the angle of the stud 3 is larger than that of the hole 4 of the bezel 1 in order to have better interference and thus guarantee higher frictional forces to improve the hold of the bezel 1 on the glass 2.

An advantage of the variant illustrated in FIG. 2A in relation to that of FIG. 3 is that it is possible to embed the end of the protruding parts exiting from the hole again after the pressing-in step in adhesive, for example, so that the bezel 2 is not easily torn off. It is certainly also possible to arrange points of adhesive at the base of the recesses 3 for the variant of FIG. 3 or any variant, in which the recesses 3 are not through passages. However, the adhesion step is then simultaneous with that of the pressing-in operation and not subsequent thereto, since the adhesive must be in place before the pressing-in occurs. In this case, the presence of adhesive could adversely affect the proper working of the pressing-in step or even be pushed back to the ends of the fastening holes, which is not desirable.

According to a preferred variant of the invention, at least the glass 2 or the bezel 1 are made from plastic material that has elastic properties suitable for the pressing-in operation. The invention is particularly suitable for an embodiment, in which the bezel 1 and the glass 2 are both made of plastic, e.g. the bezel is made of PA with a modulus of elasticity of about 2000 MPa and the glass is made of PMMA with a slightly higher modulus of elasticity in the order of 3000 MPa. Thus, according to the variant shown in FIG. 2A, the plurality of recesses 4 formed by the holes are made from a harder material than the plurality of protruding parts 3 that form the studs 3, so that the studs 3 have a tendency to deform in the holes 4. Such a variant is to be preferred to facilitate machining of the parts to be assembled, since it appears to be easier to machine holes than protruding parts in a hard material, unless the hardest part can be obtained by moulding, for example, such that the losses of material are minimised. In this case, or in all cases where production costs could be saved, it could also be provided to form the protruding parts 3 in a harder material that that used for recesses. A person skilled in the art could thus find that the invention is also suitable for a mixed solution, in which the glass 2 is made using a relatively hard crystalline material or is made of plastic and the bezel 1 is made of metal, for example.

According to the embodiment of FIG. 2A, a plurality of protruding parts 3 and recesses 4 are used for the pressing-in operation. The protruding parts consist of studs 3 and the recesses consist of holes 4. The fastening device according to this embodiment is characterised in that the holes 4 and the studs 3 have a conical shape in order to facilitate the pressing-in operation. The illustration in FIG. 2A shows a trapezoidal section for each of the studs 3 and holes 4. In other words, the virtual cone generator of the shape of the holes 4 and the studs 3 is truncated, with the vertex of this virtual cone located towards the bottom in the figure, the orientation of the arrow 14 indicating the pressing-in direction pointing towards the vertex of these cones of the holes 4 and the studs 3. Moreover, these shapes of the holes 3 and the studs 4 are preferably chosen because they are simple to machine. A skilled person could, however, conceive other geometric shapes (square, oval, dovetail etc.) depending on the machine tools available to him.

The advantage of the embodiment involving a plurality of studs 3 and holes 4 is to increase the contact surfaces between the protruding part 3 used for the pressing-in operation. Thus, the pressing-in operation will be more difficult to conduct, whereas at the same time the holding force will be increased accordingly. According to the preferred embodiment illustrated in the preceding figures and formed using the above-mentioned materials for the glass (PMMA with a modulus of elasticity of about 3000 MPa) and the bezel (PA with a hardness of 2000 MPa), a hole about 0.5 mm in diameter with walls having a conicity of about 10 degrees cooperating with a stud with a diameter of about 10% larger and about half the conicity, i.e. about 5 degrees, require a pressing-in force of about 4 to 5 newtons, i.e. a pressure of this intensity to allow the stud 3 to be correctly assembled and fastened in the hole 4. It can thus be deduced from this that the number of holes and studs necessary for a proper hold of the bezel, which according to usual production standards in the field of clockmaking can be evaluated at about 40 newtons for plastic, is relatively low, i.e. in the order to 10 (40, the holding force, divided by about 4, the holding force of each stud in its respective hole, usually equal to the pressing-in force) over the whole of the peripheral rim 11 of the glass 2 and the inside face 8 of the bezel.

Thus, according to the preferred embodiment described above, machining of several holes 4 in each of the four parts forming the peripheral rim 11 of the glass 2 allows a total pressing-in force of more than 100 newtons to be easily obtained. Thus, for bezels 1 and glasses 2 made of plastic, preferred embodiments of the invention would thus use pressing-in forces in the range of between 50 and 200 newtons, for which there are numerous possibilities for adjustment of the parameters such as the diameters of the holes and studs, as well as the number of hole/stud pairs per wall. It will be noted that within the framework of the invention, while the diameter of the stud 3 must be larger than the diameter of the hole 4 to allow the pressing-in operation, the conicity of the hole 4 in relation to that of the stud 3 could also be adjusted to allow the surfaces to mould better to one another during the pressing-in operation. To achieve this, the angle of conicity of the stud will thus preferably be chosen to be slightly smaller than the angle of conicity of the hole. However, embodiments, in which the conicity of the stud is larger than that of the hole, are also conceivable.

Figure 4A:
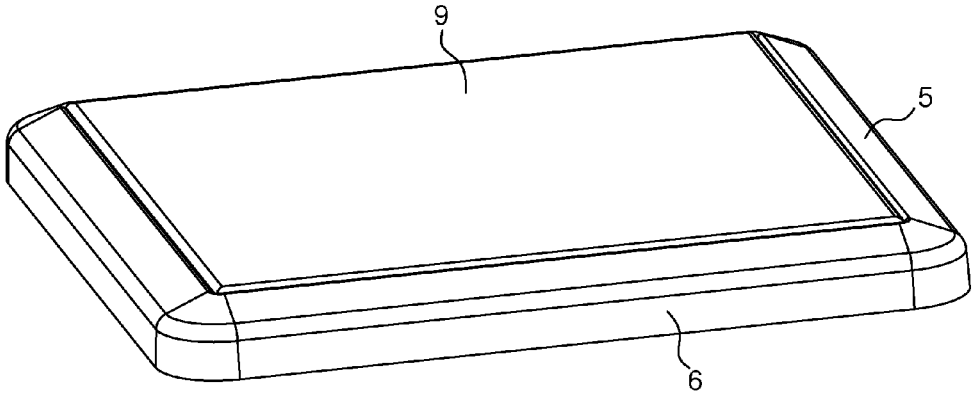
FIGS. 4A and 4B are perspective views of the bezels and glasses of FIGS. 1A and 1B in the assembled version.
Figure 4B:
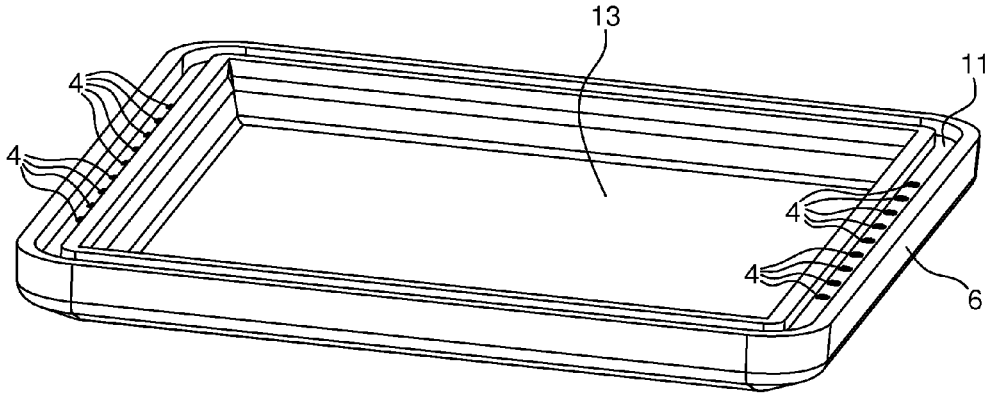

FIGS. 4A and 4B show the bezel 1 and the glass 2 in the assembled position, respectively viewed from above and below. In FIG. 4A the contour formed by the outer side wall of the bezel 6 can still be seen and the continuity of the surfaces between the upper outer surface of the glass 9 and that of the bezel 5 is evident. However, the studs and holes are now concealed. FIG. 4B, which shows the same assembly of the bezel 1 and the glass underneath, shows the end of the studs 3 that can project beyond the openings of the holes 4—besides the inside face of the bezel 13, the outer wall of the bezel 6 and the lower part of the peripheral rim 11 of the glass 2. Thus, according to this variant the recesses 3 and protruding parts 4 used for the pressing-in step are only partially concealed once this step has been performed. However, according to an alternative variant of the invention illustrated in particular by way of FIGS. 5A, 5B and 6, the recesses and protruding parts can be completely hidden within the framework of the invention, thus providing an aesthetically appealing effect for the user of the watch, on which the glass 1 and the bezel 2 are mounted.

Figure 5A:
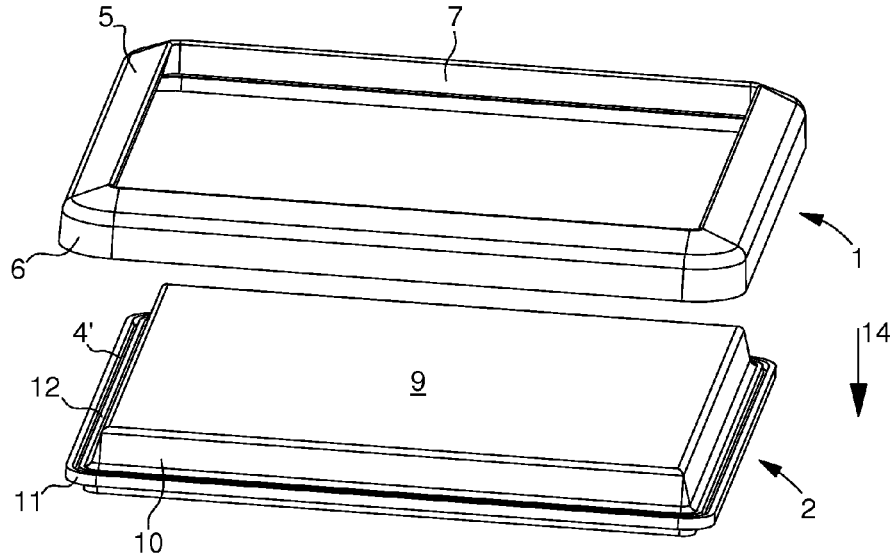
FIGS. 5A and 5B are perspective views of a bezel and a glass.
Figure 5B:
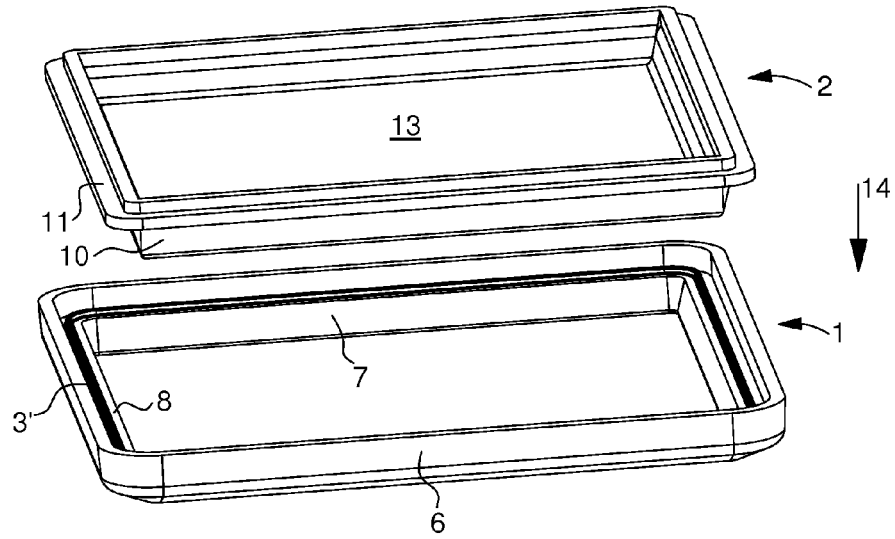

FIGS. 5A and 5B, similar to the preceding FIGS. 1A, 1B, show a variant, in which the protruding part of the invention not only consists of a plurality of studs, but also an annular collar 3', while the recess consists of an annular groove 4'. It is evident from FIG. 5A that according to the illustrated embodiment, the annular groove 4' is formed in the peripheral rim 11 of the glass 2 and that therefore, as illustrated in FIG. 5B, the annular collar 3' is located on the inside face 8 of the bezel 1. A person skilled in the art will, however, understand that the annular groove and collar 3', 4' can be machined into the peripheral rim and the lower part of the bezel 1 in any manner, so that a fastening device and method using an annular collar 3' arranged on the upper face 12 of the peripheral rim 11 of the glass 2 cooperating with an annular groove 4' formed in the inside face 8 of the bezel are also covered by the invention. To prevent any relative rotation of the bezel 1 in relation to the glass 2, the shape of the annular collar and neck 3', 4' according to this embodiment will preferably be chosen with a non-circular section, e.g. slightly oval or square section, as in FIGS. 5A and 5B. Moreover, it would also be possible for the neck 4' and the collar 3' to not extend over the entire peripheral rim 11 and only form one partial ring around this rim 11.

Figure 6:
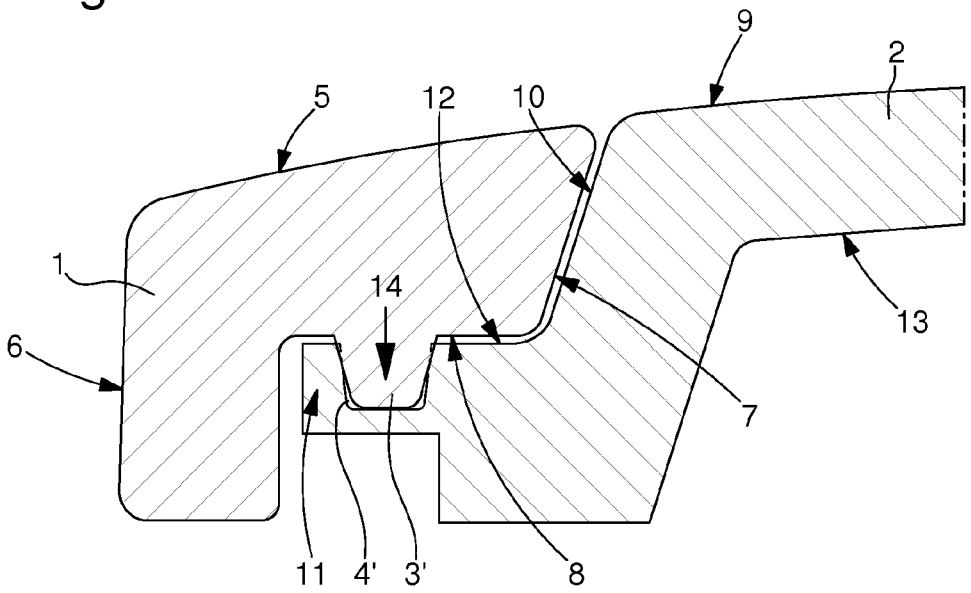
FIG. 6 is a sectional view of the configuration of the bezel and glass illustrated in FIGS. 5A and 5B.

Since the other references used in FIGS. 5A and 5B are similar in all points to those used in the description of FIGS. 1A and 1B, the reader is referred to the preceding description of these figures for their explanation. Similarly to FIG. 2A, FIG. 6 is a sectional view of this alternative variant having an annular groove 4' and an annular collar 3'. This view shows the trapezoidal section of the neck 4' and the collar 3' to facilitate the pressing-in step in a similar manner to the conical shape of the holes and studs of the preferred embodiment illustrated in FIG. 2A. As explained above, one difference between this alternative variant and the preferred variant illustrated in FIG. 2A lies in the fact that the interacting parts for the pressing-in operation, i.e. the neck 4' and the annular collar 3'. To compensate the reduction in interactive surface between the protruding parts and the recess, since only the side walls of the collar 3' and the annular groove 4' are now involved, as well as the slight reduction in depth, it would be possible, for example, to slightly modify the inclination as well as adjust the hardness of the materials used for the bezel 1 and for the glass 2 in order to assure similar pressing-in forces to those in the previous preferred embodiment, or at least assure a pressing-in force in the preferred range of 50 to 200 newtons. According to FIG. 6, the angle of the stud 3 is larger than that of the hole 4 of the bezel 1, as in FIG. 3, and the purpose of this is to have a better interference and thus assure higher frictional forces to improve the hold of the bezel 1 on the glass 2.

A person skilled in the art will understand that other variants can be envisaged by combining the geometric shapes of the illustrated variants, for example, by machining semicircular necks and collars, or necks and collars that do not extend over the entire periphery of the peripheral rim 11 of the glass 2, and holes and studs with a corresponding shape on the remaining part of the peripheral rim 11 and the inside face 8 of the bezel 1.

LIST OF REFERENCES

1 bezel
2 glass
3 protruding part: stud
3' protruding part: annular collar
4 recess: hole
4' recess: annular groove
5 upper outside face of the bezel
6 outer side wall of the bezel
7 inner side edge of the bezel
8 inside face of the bezel
9 upper outside face of the glass
10 outer side edge of the glass
11 peripheral rim of the glass
12 upper face of the peripheral rim of the glass
13 inside face of the glass
14 pressing-in direction

What is claimed is:

1. A method of fastening a glass to a watch bezel, the method comprising the steps of:

(a) providing the glass and bezel, wherein the glass has a plurality of studs or a plurality of holes or plurality of studs and holes that are integral to the glass and the bezel has a plurality of studs or a plurality of holes or a plurality of studs and holes that are integral to the bezel; and (b) pressing the studs into the holes, wherein the plurality of studs are pressed into the plurality of holes and held together in a final mutually-assembled position by continuous elastic deformation forces; and wherein the plurality of studs are pressed into the plurality of holes in a direction to achieve the final mutually-assembled position that is substantially perpendicular to a plane formed by an upper outside face of the glass.

2. The method according to claim 1, wherein the bezel is fastened to the glass and wherein the glass is immobile during the pressing-in step.

3. The method according to claim 1, wherein the pressing force is in the range of between 50 and 200 newtons.

4. The method according to claim 1, wherein the bezel comprises an upper outside face extending an upper outside face of the glass once the pressing-in step has been performed.

5. The method according to claim 1, wherein the bezel comprises an inner side edge and the glass comprises an outer side edge, and wherein both side edges are substantially vertical and free from frictional forces during the pressing-in step.

6. An assembly comprising:

(a) a glass; and (b) a watch bezel, wherein the glass has a plurality of studs or a plurality of holes or a plurality of studs and holes that are integral to the glass, wherein the bezel has a plurality of studs or a plurality of holes or a plurality of studs and holes that are integral to the bezel, and wherein the assembly is disposed so the plurality of studs to be pressed into the plurality of holes and held together in a final mutually-assembled position by continuous elastic deformation forces, wherein the plurality of studs are pressed into the plurality of holes in a direction to achieve the final mutually-assembled position, and wherein the direction is substantially perpendicular to a plane formed by an upper outside face of the glass.

7. The assembly according to claim 6, wherein at least one of the glass or the bezel is made of plastic material.

8. The assembly according to claim 7, wherein the plurality of holes are made from a harder material than the plurality of studs.

9. The assembly according to claim 6, wherein the plurality of studs and the plurality of holes are located on an inside face of the bezel or on an upper face of a peripheral rim of the glass, or on the inside face of the bezel and the upper face of the peripheral rim of the glass.

10. The assembly according to claim 1, wherein the plurality of holes and the plurality of studs are conical in shape.

* * * * *